US005114148A

United States Patent [19]

Liu

[11] Patent Number: 5,114,148

[45] Date of Patent: May 19, 1992

[54] PUZZLE DEVICE

[76] Inventor: Ming-Zen Liu, No. 34, Chung-Yung St., San-Min Dist., Kaohsiung City, Taiwan

[21] Appl. No.: 727,423

[22] Filed: Jul. 9, 1991

[51] Int. Cl.[5] ..... A63F 9/08

[52] U.S. Cl. ..... 273/153 S

[58] Field of Search ..... 273/153 S

[56] References Cited

U.S. PATENT DOCUMENTS 4,452,454 6/1984 Greene ..... 273/153 S 4,889,340 12/1989 Greene ..... 273/153 S

*Primary Examiner*—William H. Grieb

*Attorney, Agent, or Firm*—Ladas & Parry

[57] ABSTRACT

A puzzle device has a round body including at least two intersecting endless runways formed around its external surface and a plurality of intersecting points formed in the intersecting runways; and a plurality of game pieces slidably retained in the runways. The game pieces are moved from one runway to the other runway via the intersecting points so as to position the game pieces in a desired arrangement.

3 Claims, 5 Drawing Sheets

PUZZLE DEVICE

BACKGROUND OF THE INVENTION

1. Field of the Invention

This invention relates to an amusement device, more particularly to a puzzle device.

2. Description of the Related Art

Among conventional amusement devices, perhaps the most well-know is the "Rubik's Cube". The Rubik's Cube consists of 27 smaller rotating cubes, each face of which is a different color. A player rotates the smaller cubes so that each side of the overall cube is a single solid color. There is only one possible solution in the Rubik's Cube. Therefore, the player easily loses interest after he is familiar with the possible solution and able to assemble the Rubik's Cube quickly.

SUMMARY OF THE INVENTION

Therefore, the objective of this invention is to provide an improved puzzle which can be assembled in a plurality of desired arrangements to test the players's knowledge, skill, patience, or temper.

Accordingly, a puzzle device of this invention has a round body including at least two intersecting endless runways formed around its external surface and a plurality of intersecting points formed in the intersecting runways; and a plurality of game pieces slidably retained in the runways. The game pieces can be moved from one runway to the other runway via the intersecting points so as to position the game pieces in a desired arrangement.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
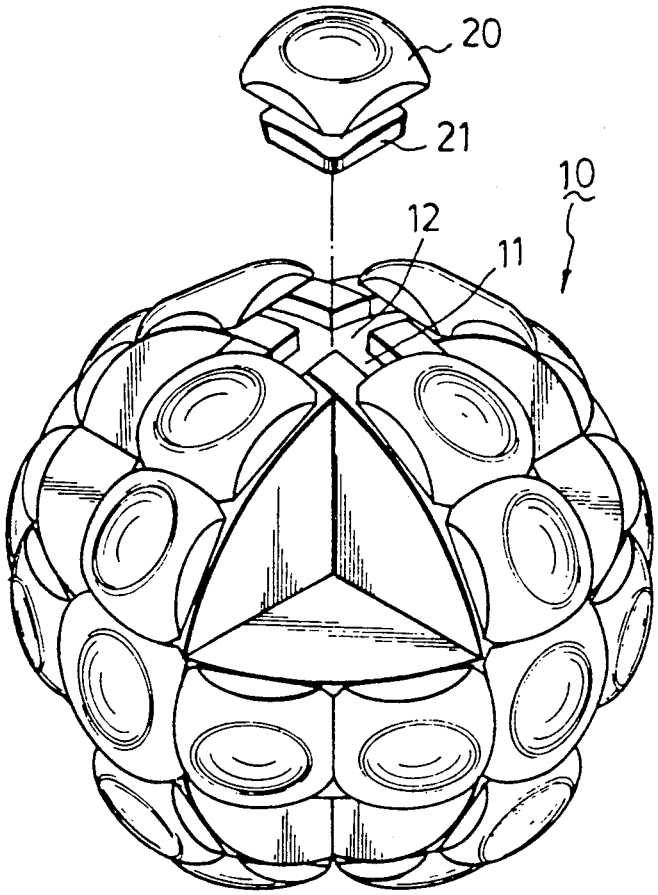
FIG. 1 is a schematic perspective view of a preferred embodiment of the puzzle device of this invention.

Referring to FIG. 1, a puzzle device of this invention includes a spherical body (10) having three intersecting circular runways (11) formed around an external surface thereof and a plurality of intersecting points (12) formed in the intersecting runways (11), and a plurality of game pieces (20) slidably retained in the runways (11).

Figure 2:
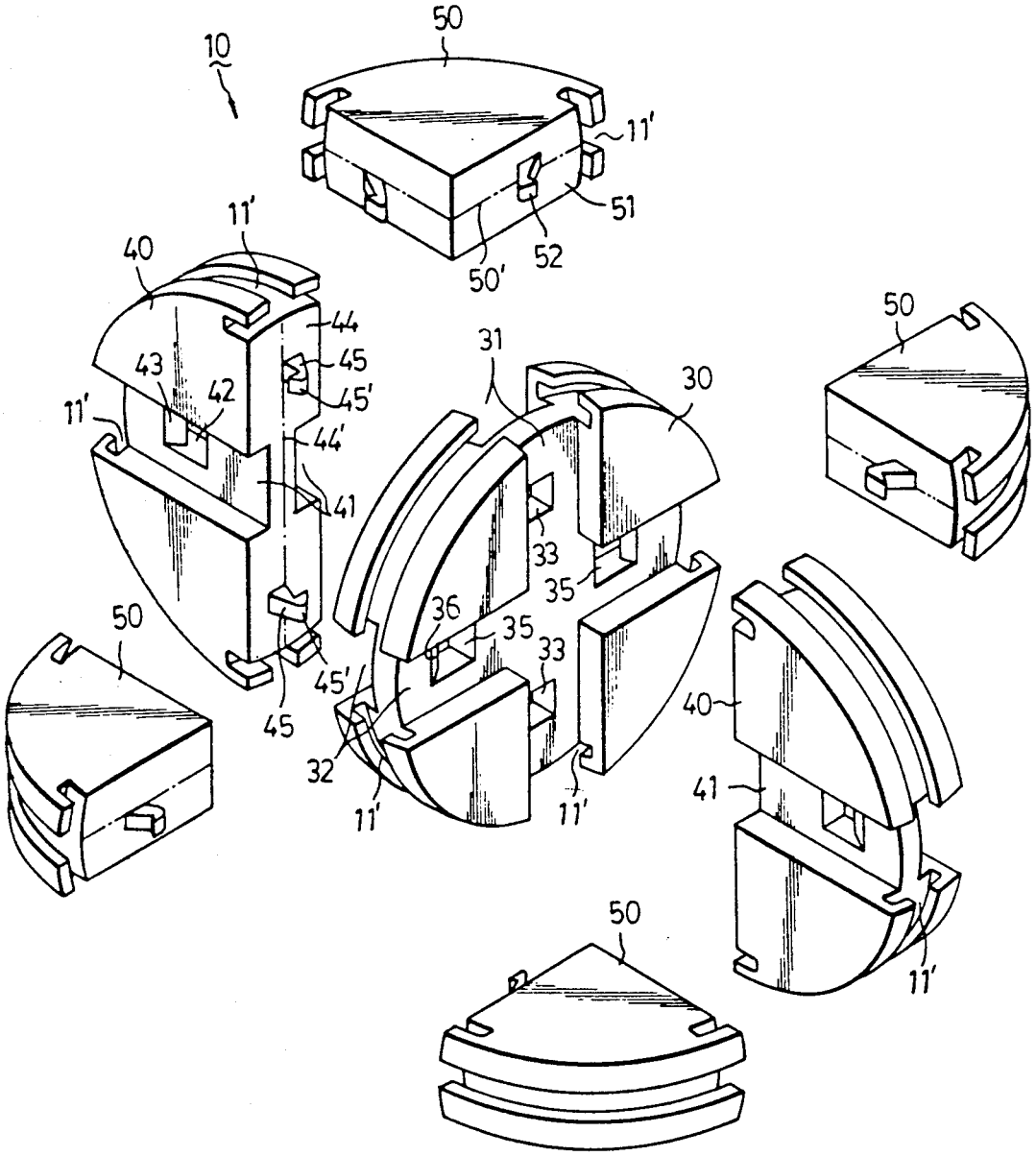
FIG. 2 is an exploded view of the preferred embodiment.

Referring to FIG. 2, the spherical body (10) includes a circular disc (30), a pair of identical semicircular discs (40), and four identical quadrant discs (50). The circular disc (30) includes a circumferential face, and two opposite circular faces. The circumferential face has a first retaining groove (11') formed therealong. Each of the circular faces has a first and a second diametric groove (31, 32) which are perpendicular to each other. The two crossed diametric grooves (31, 32) on one circular face are respectively parallel with the two crossed diametric grooves (31, 32) on the other circular face. Each of the first diametric grooves (31) has a first flat bottom. Each of the second diametric grooves (32) has a second flat bottom. The circular disc (10) has two spaced first through holes (33) accessible at the first diametric grooves (31), two spaced second through holes (35) accessible at the second diametric grooves (32), and two first engaging members (36) respectively extending into the second through holes (35).

Figure 3:
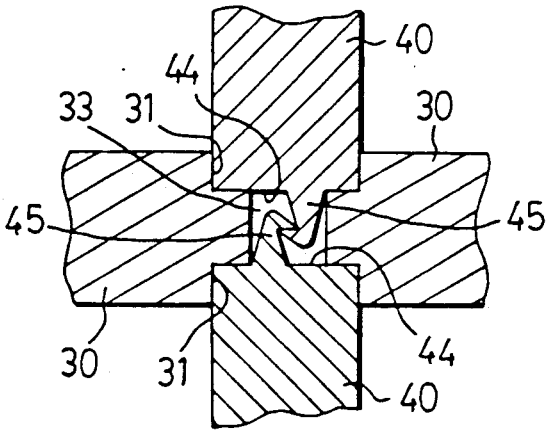
FIG. 3 is a sectional view showing that the circular disc is engaged with the semicircular discs.

Each of the pair of semicircular discs (40) includes a pair of opposite semicircular faces, a semicircular circumferential face having a second retaining groove (11') formed therealong, and a first flat face (44). Each of the opposite semicircular faces of the semicircular disc (40) includes a radial groove (41) formed thereon which extends perpendicularly to the first flat face (44) and parallel with the radial groove (41) on the other semicircular face. Each of the radial grooves (41) has a third flat bottom. Each of the semicircular discs (40) has a third through hole (42) accessible at the radial grooves (41) and a second engaging member (43) extending into the third through hole (42). Each of the first flat faces (44) has a pair of first hooks (45) extending outwards and longitudinally spaced from each other. Each of the first hooks (45) has a curved end (45'). The curved end (45') of one first hook (45) is disposed opposite to the curved end (45') of the other first hook (45') relative to a center line (44') of the first flat face (44). Also referring to FIG. 3, when the semicircular discs (40) are fitted in the first diametric grooves (31) of the circular disc (30), the first flat faces (44) are respectively engaged with the first flat bottoms of the first diametric grooves (31), and the first hooks (45) of one semicircular disc (40) are adapted to respectively pass through the first through holes (33) of the circular disc (30) and respectively lock with the first hooks (45) of the other semicircular disc (40).

Each of four quadrant discs (50) includes two opposite sector-shaped faces, a quadrant circumferential face having a third retaining groove (11') formed therealong, and a second and a third flat face (51, 53) connected to each other at a right angle. When the semicircular discs (40) are fitted in the first diametric grooves (31) and the quadrant discs (50) are respectively fitted in the second diametric grooves (32) of the circular disc (30) and the radial grooves (41) of the semicircular discs (40), the second and third flat faces (51, 53) of each of the quadrant discs (50) are respectively engaged with one of the second flat bottoms of the second diametric grooves (32) and one of the third flat bottoms of the radial grooves (41). The second and third flat faces (51, 53) respectively have a second and a third hook (52, 54) extending outwards therefrom which are respectively located at two sides of a central horizontal plane indicated as (50').

Figure 4:
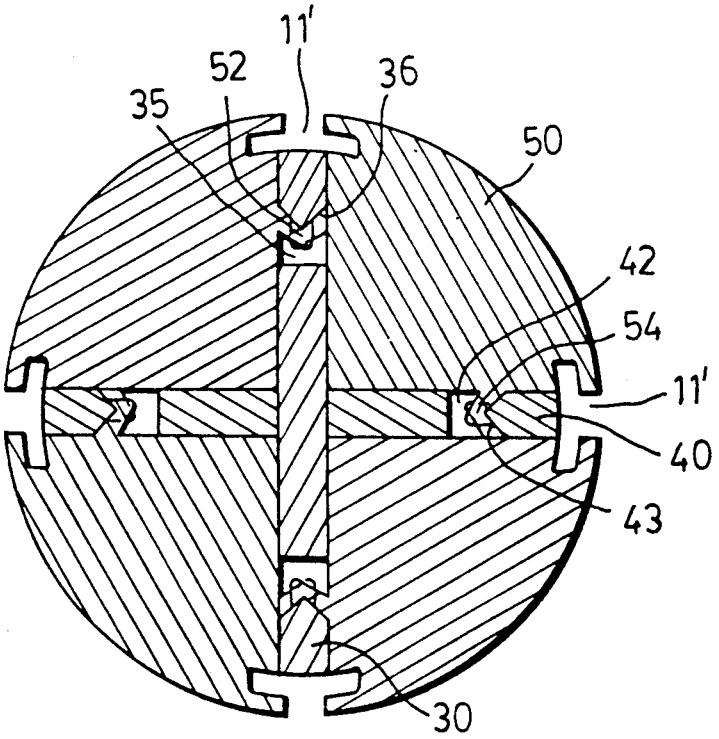
FIG. 4 is a sectional view showing that the quadrant discs are engaged with the circular disc and the semicircular discs.

Also referring to FIG. 4, when the quadrant discs (50) are fitted in the second diametric grooves (32) of the circular disc (30) and the radial grooves (41) of the semicircular discs (40), the second hook (52) of one quadrant disc (50) is adapted to pass through one of the second through holes (35) to lock with the first engaging member (36). The third hook (54) of one adjacent quadrant disc (50) is also adapted to pass through said one second through hole (35) and lock with said first engaging member (36). The third hook (54) of said one quadrant disc (50) is adapted to pass through one of the third through holes (42) to lock with the second engaging member (43) while the second hook (52) of the other adjacent quadrant disc (50) is adapted to pass through said third through hole (42) and lock with said second engaging member (43).

Figure 5:
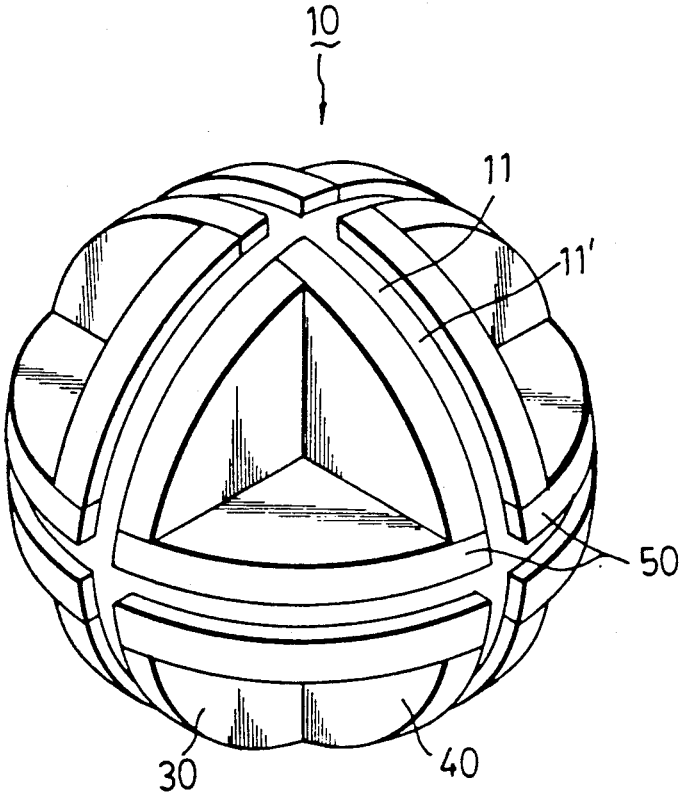
FIG. 5 is an assembled view of the spherical body.

Referring to FIGS. 1 and 5, when the semicircular discs (40) are fitted in the first diametric grooves (31) and the quadrant discs (50) are fitted in the second diametric grooves (32) and the radial grooves (41), the circular disc (30), the semicircular discs (40) and the quadrant discs (50) are assembled into the spherical body (10), and the first, second and third retaining grooves (11') cooperatively form the intersecting runways (11). The game pieces (20) should be placed in the retaining grooves (11') before the last of the quadrant discs (50) is fitted onto the circular and semicircular discs (40, 50).

Figure 6:
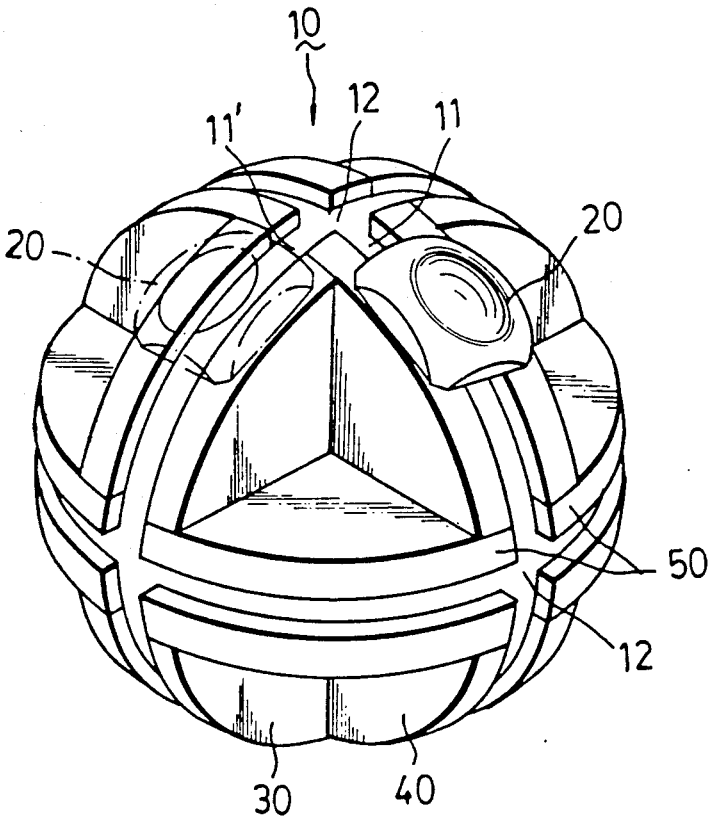
FIG. 6 is a perspective view showing that a game piece is movable in the intersecting runways through the intersecting points.

Referring to FIGS. 1 and 6, each of the game pieces (20) has a retaining portion (21) to be received in the retaining grooves (11'). The game pieces (20) may have a variety of colors and patterns formed thereon. The game pieces (20) are moved from one retaining groove (11') to the other retaining grooves (11') via the intersecting points (12) so as to position the game pieces (20) in a desired arrangement.

This above-described design allows for more than one possible arrangement, so the number of possible solutions of this invention are much higher than the possible solutions of the prior art.

While the present invention has been described in connection with what is considered the most practical and preferred embodiment, it is understood that this invention is not limited to the disclosed embodiment, but is intended to cover various arrangements included within the spirit and scope of the broadest interpretations and equivalent arrangements.

I claim:

1. A puzzle device, comprising:

a spherical body including a circular disc having two opposite circular faces and a circumferential face, said circumferential face having a first retaining groove formed therealong, each of said circular faces having a first and a second diametric groove which are perpendicular to each other, the two crossed diametric grooves on one circular face of said circular disc being respectively parallel with the two crossed diametric grooves on the other circular face of said circular disc, each of said first diametric grooves having a first flat bottom, each of said second diametric grooves having a second flat bottom, a pair of semicircular discs each of which having two opposite semicircular faces, a semicircular circumferential face having a second retaining groove formed therealong, and a first flat face, each of said opposite semicircular faces of said semicircular disc having a radial groove extending perpendicularly to said first flat face and parallel with the radial groove on the other semicircular face of said semicircular disc, each of said radial grooves having a third flat bottom, and four quadrant discs each of which having two opposite sector-shaped faces, a quadrant circumferential face having a third retaining groove formed therealong, and a second and a third flat face connected to each other at a right angle so that when said semicircular discs are respectively fitted in said first diametric grooves of said circular disc and said quadrant discs are respectively fitted in said second diametric grooves of said circular disc and said radial grooves of said semicircular discs, said first flat faces of said semicircular discs being respectively engaged with said first flat bottoms of said first diametric grooves of said circular disc, and said second and third flat faces of each of said quadrant discs being respectively engaged with one of said second flat bottoms of said second diametric grooves of said circular disc and one of said third flat bottoms of said radial grooves of said semicircular discs, said first, second and third retaining grooves cooperatively forming intersecting endless runways having a plurality of intersecting points formed in said intersecting runways; and a plurality of game pieces slidably retained in said runways, each of said game pieces being movable along said intersecting runways via said intersecting points in different routes to manipulate said game pieces into a desired arrangement.

2. A puzzle device as claimed in claim 1, further comprising means for interengaging said circular disc, said semicircular discs, and said quadrant discs, said means having interengagable hook members and hook holes respectively associate with said discs.

3. A puzzle device as claimed in claim 1, wherein said circular disc has two first through holes accessible at said first diametric grooves, two second through holes accessible at said second diametric grooves, and two first engaging members respectively extending into said second through holes, each of said semicircular discs having a third through hole accessible at said radial grooves and a second engaging member extending into said third through hole, each of said first flat faces of said semicircular discs having a pair of first hook members extending outwards therefrom, said pair of first hook members of one of said semicircular discs being adapted to respectively pass through said first through holes and lock with said pair of said first hook members of the other one of said semicircular discs when said semicircular discs are fitted in said first diametric grooves of said circular disc, said second and third flat faces of each of said quadrant discs respectively having a second and a third hook member extending outwards therefrom, said second hook member of one of said quadrant discs and said third hook member of an adjacent one of said quadrant discs being adapted to pass through one of said second through holes and lock with said first engaging member, while said third hook member of said one of said quadrant discs and said second hook member of another adjacent one of said quadrant discs being adapted to pass through said third through hole of one of said semicircular discs and lock with said second engaging member when said quadrant discs are fitted in said second diametric grooves of said circular disc and said radial grooves of said semicircular discs.

* * * * *